US010825670B2

(12) United States Patent
Shen et al.

(10) Patent No.: US 10,825,670 B2
(45) Date of Patent: Nov. 3, 2020

(54) SIGNAL PROCESSING METHOD AND SYSTEM BASED ON TIME-OF-FLIGHT MASS SPECTROMETRY AND ELECTRONIC APPARATUS

(71) Applicant: SHIMADZU CORPORATION, Kyoto (JP)

(72) Inventors: Jiaqi Shen, Shanghai (CN); Wenjian Sun, Shanghai (CN); Xiaoqiang Zhang, Shanghai (CN)

(73) Assignee: SHIMADZU CORPORATION, Kyoto (JP)

( * ) Notice: Subject to any disclaimer, the term of this patent is extended or adjusted under 35 U.S.C. 154(b) by 70 days.

(21) Appl. No.: 16/095,747

(22) PCT Filed: Jun. 12, 2017

(86) PCT No.: PCT/JP2017/021578
§ 371 (c)(1),
(2) Date: Oct. 23, 2018

(87) PCT Pub. No.: WO2018/003465
PCT Pub. Date: Jan. 4, 2018

(65) Prior Publication Data

US 2019/0172694 A1 Jun. 6, 2019

(30) Foreign Application Priority Data

Jun. 28, 2016 (CN) ..... 2016 1 0486025

(51) Int. Cl.
*H01J 49/00* (2006.01)
*H01J 49/40* (2006.01)

(52) U.S. Cl.
CPC ..... *H01J 49/0036* (2013.01); *H01J 49/40* (2013.01)

(58) Field of Classification Search
CPC ..... H01J 49/00; H01J 49/02; H01J 49/0031; H01J 49/0036; H01J 49/40
(Continued)

(56) References Cited

U.S. PATENT DOCUMENTS 6,870,156 B2 3/2005 Rather
8,063,358 B2 11/2011 Bateman et al.
(Continued)

FOREIGN PATENT DOCUMENTS

CN 103424766 A 12/2013
JP 2008-543009 A 11/2008
JP 2012-528317 A 11/2012

OTHER PUBLICATIONS

Du et al., "Improved Peak Detection in Mass Spectrum by Incorporating Continuous Wavelet Transform-based Pattern Matching", Bioinformatics, vol. 22, No. 17, Jul. 4, 2006, pp. 2059-2061. (Year: 2006).*

(Continued)

*Primary Examiner* — Jason L McCormack
(74) *Attorney, Agent, or Firm* — Tim Tingkang Xia, Esq.; Locke Lord LLP

(57) ABSTRACT

The invention provides signal processing method and system and an electronic apparatus for analysis of time-of-flight mass spectra. The method includes digitalizing an analog signal output from an ion detector to acquire complete raw time-of-flight spectra or each effective part in the raw time-of-flight spectra for a plurality of times; if the complete raw time-of-flight spectra are acquired, extracting the effective parts of each raw time-of-flight spectrum; applying a one-dimensional wavelet transform to each effective part to map to each frequency band or scale; determining positions and intensities of each spectral peak in each raw time-of-flight spectrum by detecting the maxima of an obtained wavelet coefficient distribution, and saving said peak posi- (Continued)

tion and intensity as characteristic data of each spectral peak; accumulating the characteristic data obtained by processing each raw time-of-flight spectrum and stacking the data to form spectral peak intensity/time-of-flight histogram.

16 Claims, 4 Drawing Sheets

(58) Field of Classification Search
USPC ..... 250/281, 282
See application file for complete search history.

(56) References Cited

U.S. PATENT DOCUMENTS

| | | | | |
|---|---|---|---|---|
| 2003/0218129 | A1* | 11/2003 | Rather | H01J 49/40 250/282 |
| 2009/0321628 | A1 | 12/2009 | Bateman et al. | |
| 2012/0126110 | A1 | 5/2012 | Green et al. | |
| 2015/0332906 | A1* | 11/2015 | Bark | H01J 49/0036 250/282 |

OTHER PUBLICATIONS

Du et al., "Improved Peak Detection in Mass Spectrometry by Incorporating Continuous Wavelet Transform-based Pattern Matching", Bioinformatics, vol. 22, No. 17, Jul. 4, 2006, pp. 2059-2061. (Year: 2006).*

Du et al.,"Improved peak detection in mass spectrum by incorporating continuous wavelt transform-based pattern matching", Bioinformatics., vol. 22, No. 17, Jul. 4, 2006, pp. 2059-2065.

JPO, "JP Office Action for JP Application No. 2018-550851", Japan, dated Sep. 10. 2019.

Du et al.,"Improved peak detection in mass spectrum by incorporating continuous wavelt transform-based pattern matching", Bioinformatics., vol. 22, No. 17, Jul. 4, 2006, pp. 2059-2061.

EPO (ISR/EP), "International Search Report for PCT/JP2017/021578", NL, dated Sep. 6, 2017.

SIPO, "CN Office Action and Search Report for CN Application No. 201610486025.6", CHINA, Mar. 5, 2020.

* cited by examiner

SIGNAL PROCESSING METHOD AND SYSTEM BASED ON TIME-OF-FLIGHT MASS SPECTROMETRY AND ELECTRONIC APPARATUS

TECHNICAL FIELD OF THE INVENTION

The present invention relates to the technical field of mass spectrometry, and more specifically to a signal processing method and a signal processing system for analysis of time-of-flight mass spectra, and an electronic apparatus.

BACKGROUND OF THE INVENTION

Before the application and promotion of high-speed analog-to-digital converters (ADCs) with sampling rates of gigahertz, in most commercial time-of-flight mass spectrometers a time-to-digital converter (TDC) is used for acquisition of ion signals arriving at an ion detector so as to ensure a high enough resolution. When the detected analog signal amplitude rises to a preset threshold, the TDC records the corresponding time of flight, after multiple accumulations a record number/time-of-flight histogram is obtained and then is converted into a corresponding spectrum. The main problem of using a TDC is that: after the amplitude of the signal output from the detector reaches a threshold triggering recording, it should take a finite period of time for the amplitude to decrease below the threshold. That period of time is called dead time, during which recording cannot be retriggered; therefore, the denser the spectral peak distribution is, the more likely distortion of the recorded spectrum is to occur. Since the length of the dead time is associated to the signal amplitude, it is generally considered difficult to correct such raw spectra through statistical analysis.

In recent years, high-speed ADCs are widely used in time-of-flight mass spectrometers. Compared with the TDC, the ADC can continuously digitalize the amplitude of the input analog signal with a fixed sampling rate, avoiding the dead time effect of the TDC. In addition, the sampling rate of advanced ADCs already reaches the level of capturing the full waveform of an individual spectral peak, this makes further improvement possible in the resolution of output spectra; one type of common implementation methods is to break the limit of the finite width of one individual spectral peak on the resolution by use of signal processing. Technologies disclosed in U.S. Pat. No. 6,870,156 B2, U.S. Pat. No. 8,063,358 B2 belong to this type of methods, and specifically include steps as follows:

1. Conducting analog-digital conversion on a signal output from the ion detector, and acquiring a series of raw spectra probably containing spectral peaks related to analyte ions.

2. Determining the position (time of flight) and intensity of the spectral peak in each raw spectrum by use of a peak detection algorithm, and saving as the characteristic data of each of the spectral peaks.

3. Accumulating the characteristic data of the spectral peaks obtained by processing a plurality of raw spectra and stacking the data to form a spectral peak intensity/time-of-flight histogram.

4. Performing further processing on each of the histograms so as to form a continuous spectrum for output.

The technologies disclosed in the above two patents mainly differ in that:

1. The peak detection algorithms for determining spectral peaks are different; the former is preferentially search of the zero crossing points of the first derivative of the signal, and the latter is exactly search of the zero crossing point of the second derivative of the signal.

2. The quantities for characterization of the spectral peak intensity are different; the former one is directly the raw signal amplitudes at the peak positions, and the latter one is preferentially the peak area.

3. The main purposes are different; the former one is to improve the resolution, and the latter one further includes extending the detection limit, facilitating real-time processing and simplifying output (add Step 5: conducting peak detection on the synthetic spectrum and outputting a peak centroid bar chart).

Literature [1] reports the principle, the implementation and the test result of an algorithm of peak detection on mass spectra based on the continuous wavelet transform. The procedure is to map a raw spectrum to each frequency band or scale through a one-dimensional wavelet transform, to determine the position and intensity of each spectral peak by detecting the maxima of the obtained wavelet coefficient distribution, and to filter the detected spectral peaks according to some distribution condition of the wavelet coefficient maxima. The key feature of this algorithm is that independent preprocessing is not needed, and as shown in the test result it is superior to the traditional peak detection algorithms based on direct signal amplitude analysis in the accuracy & reliability, and less susceptible to interference of noise & signal distortion. Over the years, this algorithm is widely recognized and applied in the academia of mass spectrometry.

The key of the above mentioned method of processing the signals from the time-of-flight mass spectrometer lies in Step 2-peak detection. Traditional peak detection algorithms are to directly analyze the signal amplitude; in order to ensure the stability of the result, certain preprocessing and post-processing are needed; the preprocessing includes removing baselines, denoising and smoothing, and the post-processing includes peak filtering based on inspection of signal-to-noise ratios, peak widths and peak shapes; the actual effect thereof is susceptible to the fluctuation of many factors such as the signal-to-noise ratio, waveform distortion and the spectral peak distribution density. Generally, serious noise interference will obviously increase the rate of detection of false peaks; use of denoising and smoothing or post-processing may reduce the rate of detection of false peaks, but also may reduce the rate of detection of true peaks by too much, the optimization parameter is sensitive to the fluctuation of the above factors. These problems will impact the accuracy and reliability of the final output spectra.

Use of the peak detection algorithm based on search of zero-crossing points in the signal derivative involved in U.S. Pat. No. 6,870,156 B2 and U.S. Pat. No. 8,063,358 B2 reduces the dependence on the preprocessing and the post-processing, and probably is superior to use of the peak detection algorithms based on direct signal amplitude analysis in the accuracy and the reliability; however, this algorithm is still difficult to handle complex conditions such as a low signal-to-noise ratio, serious waveform distortion and multi-peak overlap, and is subject to certain restrictions in improvement of system performance (including improvement of resolution and extension of the detection limit).

Although the peak detection algorithm based on the continuous wavelet transform reported in literature [1] probably may be used to improve the above mentioned signal processing method, the shortcoming is obvious: the calculation efficiency for the full spectrum is too low. Although the author declares that the algorithm may be used to process raw mass spectra, it is merely used for post-processing of the mass spectrum data in many literatures.

SUMMARY OF THE INVENTION

Technical Problem

In view of the above shortcomings of existing technologies, the present invention aims to provide a signal processing method and a signal processing system for analysis of time-of-flight mass spectra, and an electronic apparatus, so as to solve the problems of the peak detection algorithms in existing technologies.

Solution to Problem

In order to achieve the above aim and other relative aims, the present invention provides a signal processing method for analysis of time-of-flight mass spectra, including: (a) digitalizing an analog signal output from an ion detector to acquire a plurality of full raw time-of-flight mass spectrum or acquiring, one by one, each effective part in a plurality of raw time-of-flight mass spectra for a plurality of times; (b) if full raw time-of-flight mass spectra are acquired in step (a), extracting the effective part in each of the raw time-of-flight mass spectra; (c) applying a one-dimensional wavelet transform to each effective part in each of the raw time-of-flight mass spectra respectively to map to each frequency band or scale; (d) determining the position and the intensity of each spectral peak in each raw time-of-flight mass spectrum by detecting the maxima of the obtained wavelet coefficient distribution, and saving said peak position and intensity as the characteristic data of each of the spectral peaks; and (e) accumulating the-characteristic data of the spectral peaks obtained by processing each of the raw time-of-flight mass spectra and stacking the data to form a spectral peak intensity/time-of-flight histogram.

In an embodiment of the present invention, the signal processing method for analysis of time-of-flight mass spectra further includes: performing further processing on each of the histograms so as to form a continuous spectrum for output.

In an embodiment of the present invention, in step (b), the effective spectrum parts are extracted from the raw time-of-flight mass spectrum by taking a comparison result, which is obtained by comparing the signal amplitude of each data point in the raw time-of-flight mass spectrum with a threshold correlated with the time-of-flight interval in which the data point is located, as a condition; the implementation mode thereof includes any one of the following ways: 1) setting a plurality of thresholds, each of which is correlated with one time-of-flight interval defined in the raw time-of-flight mass spectrum, and comparing the signal amplitude of each data point in each time-of-flight interval with the corresponding threshold to identify and extract the part on which the signal amplitude is higher than the threshold as the effective spectrum part; 2) setting a signal comparator, of which a first input terminal is connected to the ion detector to receive the output analog signal and of which a second input terminal inputs a signal whose amplitude is the threshold, and, when converting the analog signal into a digital signal, recording the moments when the output state of the comparator reverses, and extracting the part of the raw time-of-flight mass spectrum by taking the said recorded moments as starting/ending points of the effective spectrum parts.

In an embodiment of the present invention, detecting the maxima of the obtained wavelet coefficient distribution includes: filtering the detected wavelet coefficient distribution maxima with a preset criterion, so as to determine the position and intensity of each spectral peak therein; the criterion includes one of the followings or a combination thereof: 1) the frequency band or scale of the maxima location is within a preset range; 2) the length of a corresponding ridge line reaches a preset threshold, the so-called ridge line is formed by the following steps: first searching the maxima on the said two-dimensional wavelet coefficient distribution (with respect to both time and scale) and set as the starting point; connecting each said starting point to the neighboring maxima on the one-dimensional wavelet coefficient distribution with respect to time on the next scale/frequency band (larger or smaller); extending each line to the neighboring maxima on the one-dimensional wavelet coefficient distribution with respect to time on the next scale/frequency band; and so forth until the upper/lower limit of the range of the scale/frequency band is reached; and 3) the corresponding signal-to-noise ratio reaches a preset threshold.

In an embodiment of the present invention, the signal processing method for analysis of time-of-flight mass spectra further includes: stacking the accumulated characteristic data of the spectral peaks and merging at least two adjacent time-of-flight intervals to form the spectral peak intensity/time-of-flight histogram.

In an embodiment of the present invention, the signal processing method for analysis of time-of-flight mass spectra is implemented through a plurality of or multiple groups of arithmetical units, the arithmetical unit including one of the followings: (1) field-programmable gate arrays; (2) digital signal processors; (3) graphics processing units; or a combination thereof.

In an embodiment of the present invention, the mode of implementing through multiple groups of arithmetical units includes: each group of the arithmetical units processes the raw time-of-flight mass spectra assigned thereto respectively; and each of the effective spectrum parts extracted from each of the raw time-of-flight mass spectra is assigned to each of the arithmetical units in the arithmetical unit group being assigned to process that raw time-of-flight mass spectrum for further processing.

In an embodiment of the present invention, after step (b), the method further includes: accumulating the acquired effective parts of the plurality of continuously collected raw time-of-flight mass spectra, the number of the plurality of raw time-of-flight mass spectra being 1/N of the number of the raw time-of-flight mass spectra required to be processed to form one spectral peak intensity/time-of-flight histogram, N being an integer not less than 20, and then executing step (c) and the following steps on the accumulated result spectra.

In an embodiment of the present invention, after step (a), the method further includes: accumulating the acquired plurality of continuously collected raw time-of-flight mass spectra, the number of the plurality of raw time-of-flight mass spectra being 1/N of the number of the raw time-of-flight mass spectra required to be processed to form one spectral peak intensity/time-of-flight histogram, N being an integer not less than 20, and then executing step (b) and the following steps on the accumulated result spectra.

In order to achieve the above aim and other relative aims, the present invention provides a signal processing system for analysis of time-of-flight mass spectra, including: a raw spectrum acquisition module, which is configured to digitalize an analog signal output from an ion detector to acquire a plurality of full raw time-of-flight mass spectra or acquire, one by one, each effective part in a plurality of raw time-of-flight mass spectra for a plurality of times; an optional extraction module, which is configured to extract the effective part from each full raw time-of-flight mass spectrum; a wavelet transform module, which is configured to apply a one-dimensional wavelet transform to each effective part in each raw time-of-flight mass spectrum respectively to map to each frequency band or scale; a peak detection module, which is configured to determine information on the position and intensity of each spectral peak in each raw time-of-flight mass spectrum by detecting the maxima of the obtained wavelet coefficient distribution, and to save information on the position and intensity as the characteristic data of each spectral peak; and an analysis module, which is configured to accumulate the characteristic data of the spectral peaks obtained by processing each of the raw time-of-flight mass spectra and stack the data to form a spectral peak intensity/time-of-flight histogram.

In an embodiment of the present invention, the signal processing system for analysis of time-of-flight mass spectra further includes: a continuous spectrum processing module, which is configured to perform further processing on each histogram so as to form a continuous spectrum for output.

In an embodiment of the present invention, in the signal processing system for analysis of time-of-flight mass spectra, the effective spectrum part is extracted from the raw time-of-flight mass spectrum by taking a comparison result, which is obtained by comparing the signal amplitude of each data point in the raw time-of-flight mass spectrum with a threshold correlated with the time-of-flight interval in which the data point is located, as a condition; the implementation mode thereof includes any one of the following ways: 1) setting a plurality of thresholds, each of which is correlated with one time-of-flight interval defined in the raw time-of-flight mass spectrum, and comparing the signal amplitude of each data point in each time-of-flight interval with the corresponding threshold to identify and extract the part on which the signal amplitude is higher than the threshold as the effective spectrum part; 2) setting a signal comparator, of which a first input terminal is connected to the ion detector to receive the output analog signal and of which a second input terminal inputs a signal whose amplitude is at the threshold, and, when converting the analog signal into a digital signal, recording the moments when the output state of the comparator reverses, and extracting the part of the raw time-of-flight mass spectrum by taking the said recorded moments as starting/ending points of the effective spectrum parts.

In an embodiment of the present invention, in the signal processing system for analysis of time-of-flight mass spectra, detecting the maxima of the obtained wavelet coefficient distribution includes: filtering the detected wavelet coefficient distribution maxima with a preset criterion, so as to determine the position and intensity of each spectral peak therein; the criterion includes one of the followings or a combination thereof: 1) the frequency band or scale of the maxima location is within a preset range; 2) the length of a corresponding ridge line reaches a preset threshold, the so-called ridge line is formed by the following steps: first searching the maxima on the said two-dimensional wavelet coefficient distribution (with respect to both time and scale) and set as the starting point; connecting each said starting point to the neighboring maxima on the one-dimensional wavelet coefficient distribution with respect to time on the next scale/frequency band (larger or smaller); extending each line to the neighboring maxima on the one-dimensional wavelet coefficient distribution with respect to time on the next scale/frequency band; and so forth until the upper/lower limit of the range of the scale/frequency band is reached; and 3) the corresponding signal-to-noise ratio reaches a preset threshold.

In an embodiment of the present invention, the continuous spectrum processing module is further configured to stack the accumulated characteristic data of spectral peaks and merge at least two adjacent time-of-flight intervals to form the spectral peak intensity/time-of-flight histogram.

In an embodiment of the present invention, the signal processing system for analysis of time-of-flight mass spectra includes a plurality of or multiple groups of arithmetical units to realize functions, the arithmetical unit including one of the followings: (1) field-programmable gate arrays; (2) digital signal processors; (3) graphics processing units; or a combination thereof.

In an embodiment of the present invention, in the signal processing system for analysis of time-of-flight mass spectra, the mode of implementing through multiple groups of arithmetical units includes: each group of the arithmetical units processes the raw time-of-flight mass spectrum assigned thereto respectively; and each of the effective spectrum parts extracted from each of the raw time-of-flight mass spectra is assigned to each of the arithmetical units in the arithmetical unit group being assigned to process that raw time-of-flight mass spectrum for further processing.

In an embodiment of the present invention, the signal processing system for analysis of time-of-flight mass spectra further includes: a module for accumulation of the effective spectrum parts, which is configured to accumulate the effective parts of a plurality of continuously collected raw time-of-flight mass spectra acquired by the extraction module, the number of the plurality of raw time-of-flight mass spectra being 1/N of the number of the raw time-of-flight mass spectra required to be processed to form one spectral peak intensity/time-of-flight histogram, N being an integer not less than 20; the module for accumulation of the effective spectrum parts outputs the accumulation result of the effective spectrum parts of a plurality of the raw spectra to the wavelet transform module for subsequent processing.

In an embodiment of the present invention, the signal processing system for analysis of time-of-flight mass spectra further includes: a spectrum accumulation module, which is configured to accumulate a plurality of raw time-of-flight mass spectra continuously acquired by the extraction module, the number of the plurality of raw time-of-flight mass spectra being 1/N of the number of the raw time-of-flight mass spectra required to be processed to form one spectral peak intensity/time-of-flight histogram, N being an integer not less than 20; the spectrum accumulation module outputs the accumulation result of the plurality of raw time-of-flight mass spectra to the extraction module for subsequent processing.

In order to achieve the above aim and other relative aims, the present invention provides an electronic apparatus, including the signal processing system for analysis of time-of-flight mass spectra described above.

As described above, the signal processing method and signal processing system for analysis of time-of-flight mass spectra and the electronic apparatus provided by the present invention include the following steps: (a) digitalizing an analog signal output from an ion detector to acquire a plurality of raw time-of-flight mass spectra; (b) extracting the effective part in each of the raw time-of-flight mass spectra; (c) applying a one-dimensional wavelet transform to each effective part in each of the raw time-of-flight mass spectra respectively to map to each frequency band or scale; (d) determining information on the position and intensity of each spectral peak in each raw time-of-flight mass spectrum by detecting the maxima of the obtained wavelet coefficient distribution, and saving information on the position and intensity as the spectral peak characteristic data of each of the spectral peak; (e) accumulating the characteristic data of the spectral peaks obtained by processing each of the raw time-of-flight mass spectra and stacking the data to form a spectral peak intensity/time-of-flight histogram.

The present invention has benefits as follows.

The peak detection algorithm based on wavelet transform used in the present invention, which, compared with the previous signal processing methods of the same type used on the time-of-flight mass spectrometer, for example, the same type of methods disclosed in U.S. Pat. No. 6,870,156 B2 and U.S. Pat. No. 8,063,358 B2, avoids the preprocessing that most conventional peak detection algorithms rely on and that will bring an obvious uncertainty to the result, and therefore can effectively handle some complex conditions such as low signal-to-noise ratios, serious waveform distortion and multi-peak overlap, and thus improves the accuracy and reliability of the peak detection results and thus of the final output spectra.

In the method disclosed in the U.S. Pat. No. 6,870,156 B2, each spectral peak intensity in the characteristic data of spectral peaks is characterized by the raw signal amplitude at the peak position; while in the method disclosed in the U.S. Pat. No. 8,063,358 B2, that is characterized by the area covered by the associated spectral peak on the spectrum (peak area). Generally, the latter characterization is more comprehensive and reliable. In the implementation of the present invention each spectral peak intensity is characterized by the maxima of the wavelet coefficient distribution; according to related discussions in literature [1], actually, the maxima of the wavelet coefficient distribution on effective frequency bands or scales is approximately proportional to the peak area of the associated spectral peak when compared with the characterization of the spectral peak intensity in the previous methods of the same type; accordingly, it is estimated that the-use of the method described in the present invention can improve the accuracy and reliability of the spectral peak intensity in the peak detection results and thus of the final output spectra.

Applying the peak detection algorithm based on the wavelet transform to signal processing on a time-of-flight mass spectrometer has one practical problem that the calculation efficiency is too low. To implement the method provided by the present invention, it is needed to first extract the effective part in each raw time-of-flight mass spectrum and then to perform peak detection only on the extracted effective spectrum parts using the peak detection algorithm; compared with the method reported in literature [1], the method described by the present invention not only greatly reduces the amount of calculation, but also facilitates parallel computing, under the promise of not affecting the processing result, thus being beneficial for obtaining a signal processing rate required by actual applications at a low cost.

DESCRIPTION OF DESIGNATORS

501 raw spectrum acquisition module
502 extraction module
503 wavelet transform module
504 peak detection module
505 analysis module
S101-S105 steps
S201-S206 steps

DETAILED DESCRIPTION OF EMBODIMENTS

Embodiments of the present invention are described below through specific examples. Those skilled in the art may easily learn other advantages and functions of the present invention from the content disclosed in the specification. The present invention also may be implemented or applied through other different embodiments, and what details described in the present invention may be modified or changed based on different views and applications without departing from the spirit of the present invention. It should be noted that following embodiments and characteristics in the embodiments may be mutually combined if no conflict is caused.

It should be noted that the drawings provided in the following embodiments are simply to illustrate the basic idea of the present invention in a schematic way, only showing components relevant to the present invention but drawn according to the number, shape and dimension of the components during actual implementation. During actual implementation, the shape, number and proportion of each component may be changed randomly and the layout of components might be more complex.

The technical scheme of the present invention is applied to the technical field of mass spectrometric analysis.

Figure 1:
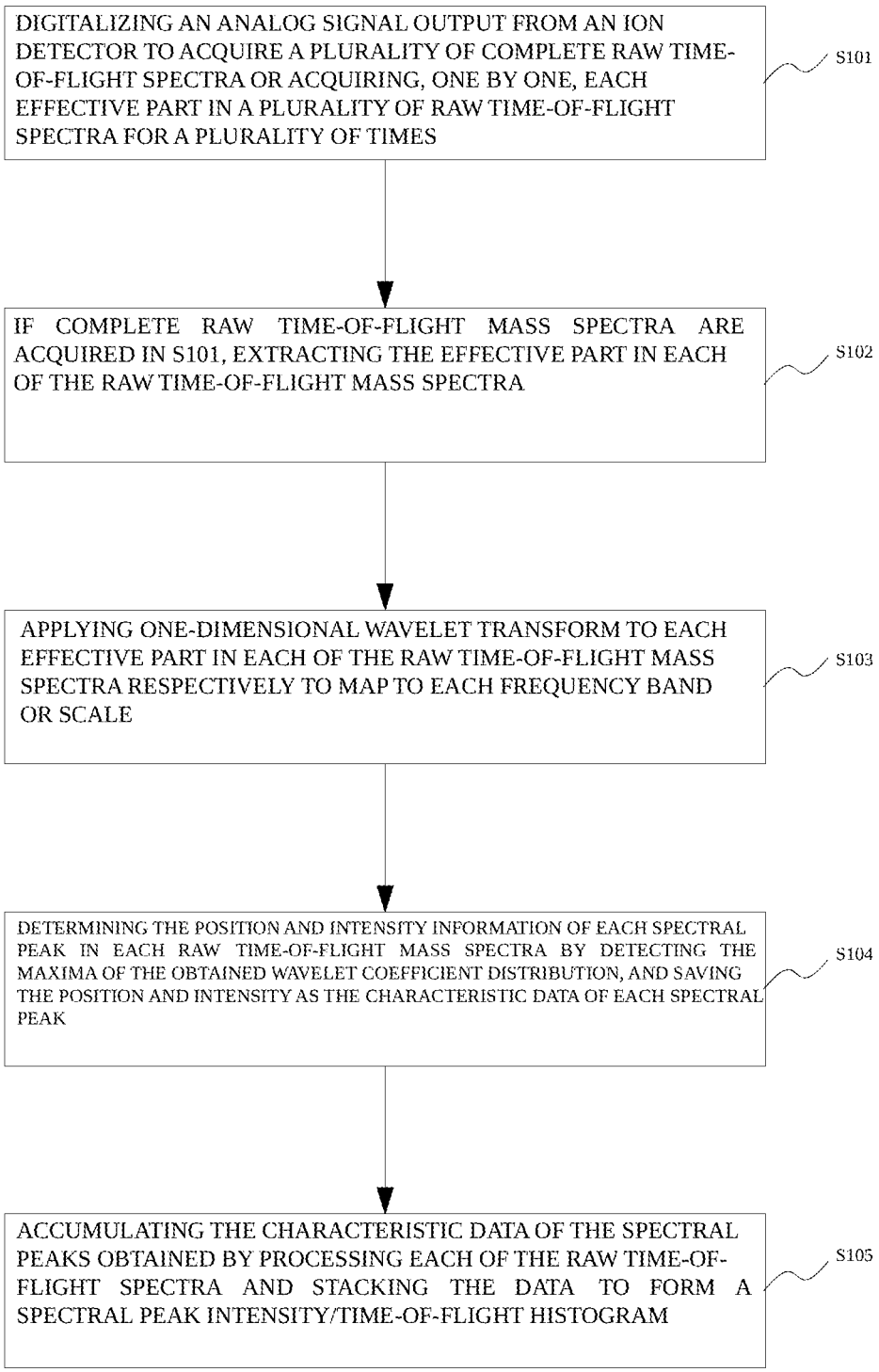
FIG. 1 shows a flowchart of a signal processing method for analysis of time-of-flight mass spectra in an embodiment of the present invention.

As shown in FIG. 1, the present invention provides a signal processing method for analysis of time-of-flight mass spectra, including:

S101: digitalizing an analog signal output from an ion detector to acquire a plurality of full raw time-of-flight mass spectra or acquiring, one by one, each effective part in a plurality of raw time-of-flight mass spectra for a plurality of times.

Specifically, the input signal comes from a digital signal acquisition unit of the time-of-flight mass spectrometer, that is, a plurality of raw time-of-flight mass spectra probably containing spectral peaks corresponding to analyte ions is acquired by digitalizing the analog signal output from the ion detector.

S102: if full raw time-of-flight mass spectra are acquired in S101, extracting the effective part in each of the raw time-of-flight mass spectra.

Specifically, the effective spectrum part is extracted from the source raw time-of-flight mass spectrum by taking a comparison result, which is obtained by comparing the signal amplitude of each data point in the raw time-of-flight mass spectrum with a threshold correlated with the time-of-flight interval in which the data point is located, as a condition; the implementation mode thereof includes any one of the following ways: 1) setting a plurality of thresholds, each of which is correlated with one time-of-flight interval defined in the raw time-of-flight mass spectrum, and comparing the signal amplitude of each data point in each time-of-flight interval with the corresponding threshold to identify and extract the part on which the signal amplitude is higher than the threshold as the effective spectrum part; 2) setting a signal comparator, of which a first input terminal is connected to the ion detector to receive the output analog signal and of which a second input terminal inputs a signal whose amplitude is the threshold, and, when converting the analog signal into a digital signal, recording the moments when the output state of the comparator reverses, and extracting the part of the raw time-of-flight mass spectrum by the said recorded moments as starting/ending points of the effective spectrum parts.

S103: applying a one-dimensional wavelet transform to each effective part in each of the raw time-of-flight mass spectra respectively to map to each frequency band or scale.

S104: determining information on the position and intensity of each spectral peak in each raw time-of-flight mass spectrum by detecting the maxima of the obtained wavelet coefficient distribution, and saving information on the position and intensity as the characteristic data of each spectral peak.

Specifically, peak detection based on a one-dimensional wavelet transform is performed on each of the effective spectrum parts; each wavelet transform applied to one effective spectrum part forms a two-dimensional distribution of wavelet coefficients with respect to time and scale, the maxima of each wavelet coefficient distribution are detected, and the detected maxima are filtered with a preset criterion, so as to determine the position and the intensity of each spectral peak therein; the criterion includes one of the following or a combination thereof: 1) the frequency band or scale of the maxima location is within a preset range; 2) the length of a corresponding ridge line reaches a preset threshold, the so-called ridge line is formed by the following steps: first searching the maxima on the said two-dimensional wavelet coefficient distribution (with respect to both time and scale) and set as the starting point; connecting each said starting point to the neighboring maxima on the one-dimensional wavelet coefficient distribution with respect to time on the next scale/frequency band (larger or smaller); extending each line to the neighboring maxima on the one-dimensional wavelet coefficient distribution with respect to time on the next scale/frequency band; and so forth until the upper/lower limit of the range of the scale/frequency band is reached; and 3) the corresponding signal-to-noise ratio reaches a preset threshold.

S105: accumulating the characteristic data of the spectral peaks obtained by processing each of the raw time-of-flight mass spectra and stacking the data to form a spectral peak intensity/time-of-flight histogram.

Specifically, the characteristic data of the spectral peaks obtained by processing a plurality of the raw time-of-flight mass spectra is accumulated and is stacked to form one spectral peak intensity/time-of-flight histogram; the number of the raw time-of-flight mass spectra required to be processed to form one histogram is not limited, generally taking a constant in the range of 20 to 200; the so-called accumulating means that: the intensities of the spectral peaks located in each interval forming one histogram are summed to serve as the spectral peak intensity correlated with this interval in the histogram.

Further, each of the histograms may be further improved, so as to form a continuous spectrum for output; specifically, the spectral peak intensity distributed in each time-of-flight interval of the histogram is converted into a distribution density function of the spectral peak intensity with respect to the time of flight; generally, the value of the distribution density function at a certain time-of-flight position is directly proportional to the spectral peak intensity in the interval covering that position in the original histogram.

The above embodiment may be changed as actually needed, for example, other optimization steps may be added to form this embodiment, for instance:

In an embodiment of the present invention, after S102, the method may further include: accumulating the acquired effective parts of the plurality of continuously acquired raw time-of-flight mass spectra, the number of the plurality of raw time-of-flight mass spectra being 1/N of the number of the raw time-of-flight mass spectra required to be processed to form one spectral peak intensity/time-of-flight histogram, N being an integer not less than 20, and then executing S103 and the following steps to achieve the accumulation result.

In an embodiment of the present invention, after S101, the method may further include: accumulating the plurality of continuously acquired raw time-of-flight mass spectra, the number of the plurality of raw time-of-flight mass spectra being 1/N of the number of the raw time-of-flight mass spectra required to be processed to form one spectral peak intensity/time-of-flight histogram, N being an integer not less than 20, and then executing S102 and the following steps to achieve the accumulation result.

Herein, the so-called accumulating means that: the sum of all the signal amplitudes recorded at identical or close time of flight (close means that the difference value is less than a preset value) in the raw time-of-flight mass spectra or in the effective parts serve as the signal amplitude correlated with the time-of-flight in the result spectrum.

Figure 2:
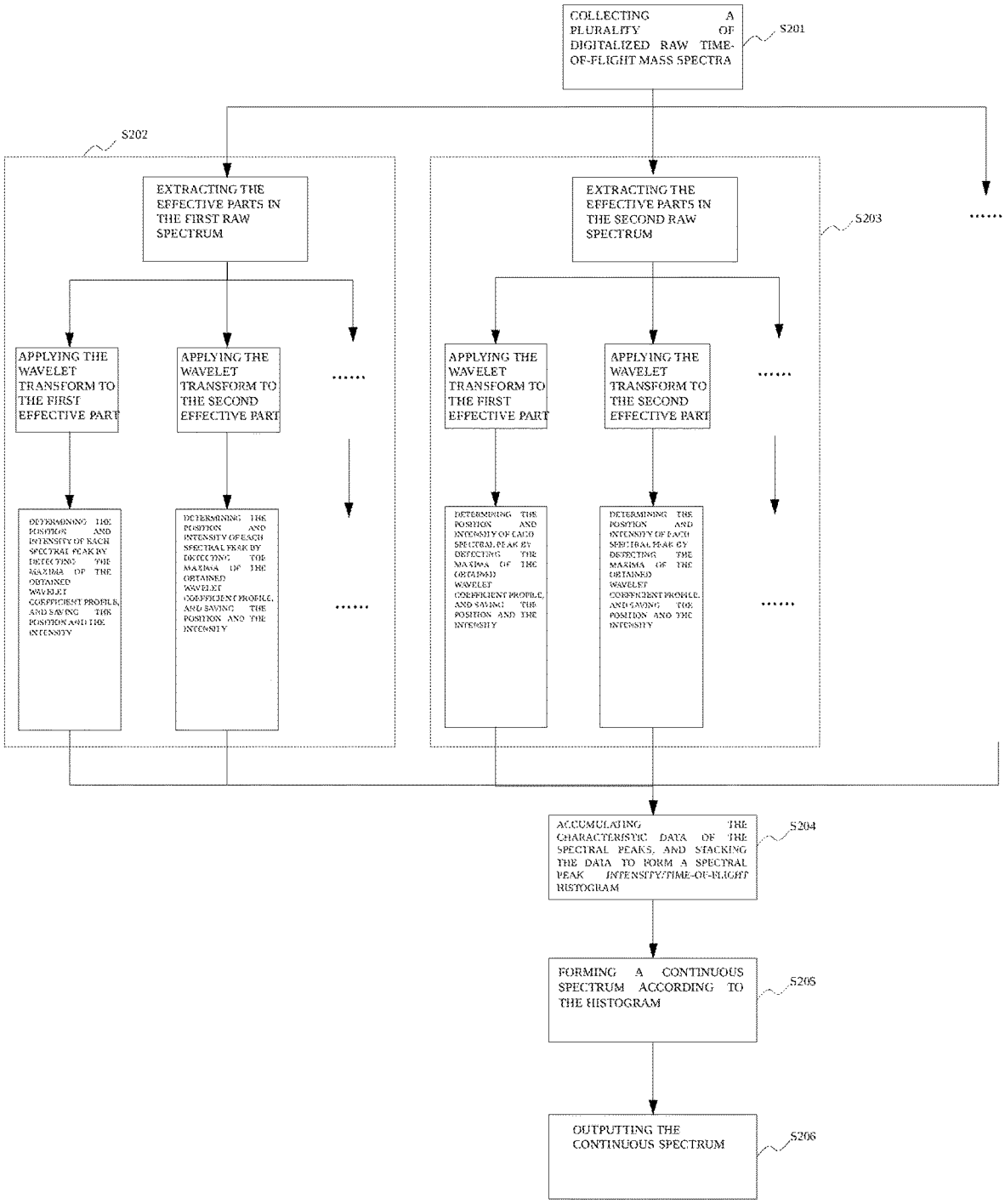
FIG. 2 shows a diagram of the branch steps of a signal processing method for analysis of time-of-flight mass spectra in an embodiment of the present invention.

Specifically, the diagram of a specific implementation of the above method embodiment is shown in FIG. 2, that is, the diagram of parallel computing for extracting each effective part of each raw spectrum and processing each extracted effective part; due to independence of processing different raw spectra and different effective spectrum parts, there are a plurality of parallel branch parts as shown in FIG. 2 (for example, the branch part of extracting effective spectrum parts, and/or the branch part of applying the wavelet transform to the extracted effective parts, etc.), which may be one-by-one assigned to a plurality of arithmetic units for processing; the arithmetical unit includes one of the followings: (1) field-programmable gate arrays; (2) digital signal processors; (3) graphics processing units; or a combination thereof; in specific implementation, for example, different raw time-of-flight mass spectra are assigned to different groups of arithmetical units for processing, and different effective parts extracted from one raw time-of-flight mass spectrum are assigned to different arithmetical units from a certain group for further processing—peak detection; preferably, after S201, the first raw time-of-flight mass spectrum in FIG. 2 is processed on the No. 1 arithmetical unit group (denoted as S202), on the arithmetical unit a in the No. 1 arithmetical unit group the effective part in the first raw spectrum is extracted, on the arithmetical unit b in the No. 1 arithmetical unit group the wavelet transform is applied to the first effective part, on the arithmetical unit c in the No. 1 arithmetical unit group the maxima of the obtained wavelet coefficient distribution are detected, and the position and intensity of each spectral peak therein is saved; the other arithmetical units in the first group of arithmetical units work by such analogy; the second raw spectrum may be processed on the No. 2 arithmetical unit group (denoted as S203), the assignment thereof is the same as S202, and so is that of processing of the n-th raw spectrum; then, S204, S205 and S206 are executed subsequently.

Figure 3:
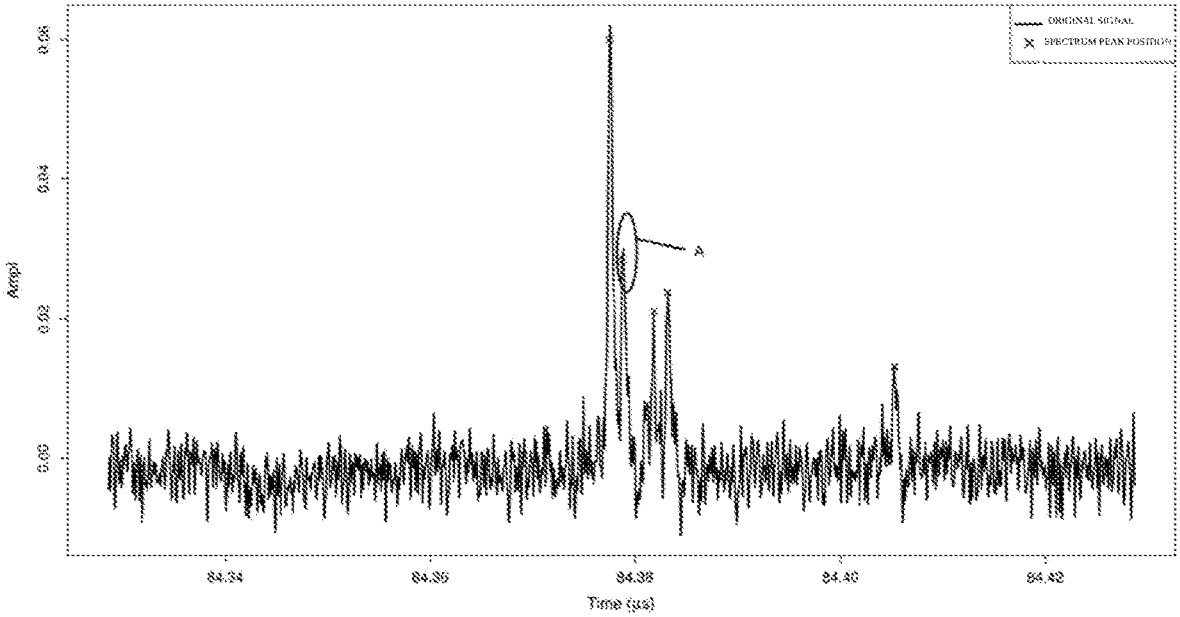
FIG. 3 shows a diagram of the waveform of some spectral peaks detected by use of a peak detection method in an embodiment of the present invention.

The waveform of a spectral peak detected by use of the peak detection method based on the wavelet transform involved in the present invention is shown in FIG. 3, in which, the solid line represents the raw spectrum and the crossing points mark the positions of the spectral peaks detected by use of the peak detection method based on the wavelet transform involved in the present invention. In the five spectral peaks detected shown in FIG. 3, the second spectral peak A is very difficult to detect using the conventional method based on sliding window analysis: when the window is relatively narrow, since the surrounding spectral peaks are dense, the local signal-to-noise ratio around this spectral peak position is too low and this spectral peak is easily filtered out as noise; when the window is relatively wide, this spectral peak is also easily removed by the smoothing in the preprocessing process. Use of the peak detection method based on the wavelet transform can effectively filter noise and make the spectral peak clearer. Compared with use of the conventional peak detection methods, use of the peak detection method provided by the present invention can improve the reliability of the final output result when the spectral peaks distribute densely.

Figure 4:
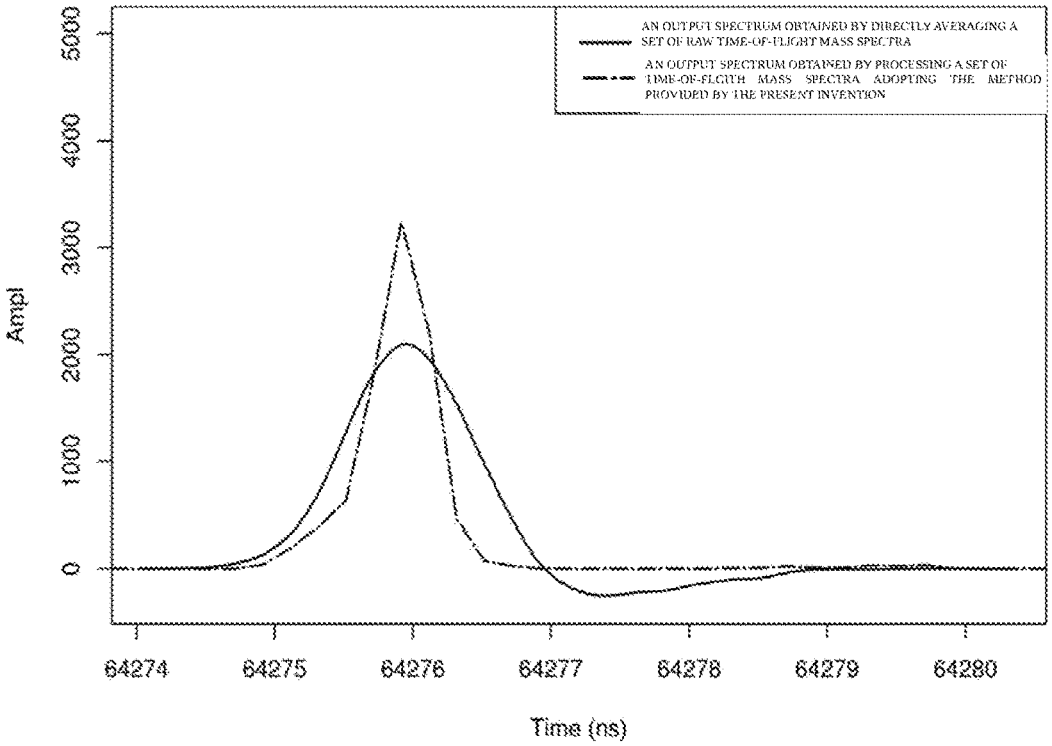
FIG. 4 shows the plot of a final output spectrum obtained by processing a set of raw time-of-flight mass spectra using the signal processing method in an embodiment of the present invention together with the output spectrum obtained by directly averaging or summing the same set of raw spectra for comparison.

FIG. 4 shows a final output spectrum obtained by use of the signal processing method provided by the present invention for processing a set of raw time-of-flight mass spectra (represented by the dot dash line), from which it can be seen that the spectral peak distribution is narrower, and the output resolution is higher when compared with the output spectrum obtained by directly averaging or summing the same raw spectrum set (represented by the solid line).

Figure 5:
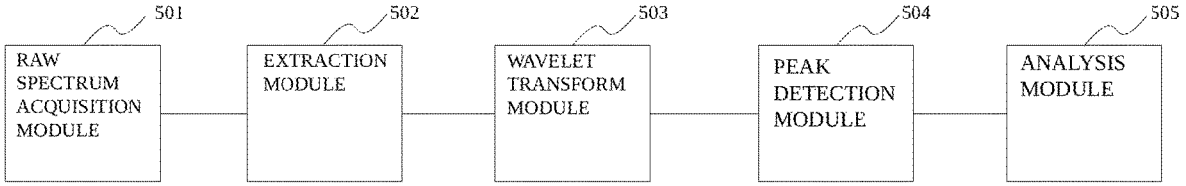
FIG. 5 shows a diagram of the modules of a signal processing system for analysis of time-of-flight mass spectra in an embodiment of the present invention.

As shown in FIG. 5, the present invention provides a signal processing system for analysis of time-of-flight mass spectra, the principle of which is approximately the same as that of the above method embodiments; the inter-operable technical features in the embodiments are not repeated below; the system includes: a module for acquisition of raw time-of-flight mass spectra 501, which is configured to digitalize an analog signal output from an ion detector to acquire a plurality of raw time-of-flight mass spectra; an optional extraction module 502, which is configured to extract the effective parts from each full raw time-of-flight mass spectrum; a wavelet transform module 503, which is configured to apply the one-dimensional wavelet transform to each extracted effective spectrum part to map to each frequency band or scale; a peak detection module 504, which is configured to determine information on the position and intensity of each spectral peak in each raw time-of-flight mass spectrum by detecting the maxima of the obtained wavelet coefficient distribution, and save the position and intensity as the characteristic data of each detected spectral peak; and an analysis module 505, which is configured to accumulate the characteristic data of the spectral peaks obtained by processing each of the raw time-of-flight mass spectra and to stack the data to form a spectral peak intensity/time-of-flight histogram.

In an embodiment of the present invention, the signal processing system for analysis of time-of-flight mass spectra further includes: a continuous spectrum processing module, which is configured to perform further processing on each histogram so as to form a continuous spectrum for output.

In an embodiment of the present invention, in the extraction module of the signal processing system for analysis of time-of-flight mass spectra, the effective spectrum part is extracted from the raw time-of-flight mass spectrum by comparing the signal amplitude of each data point in the raw time-of-flight mass spectrum with a threshold correlated with the time-of-flight interval in which the data point is located, as a condition; the implementation mode thereof includes any one of the following ways: 1) setting a plurality of thresholds, each of which is correlated with one time-of-flight interval defined in the raw time-of-flight mass spectrum, and comparing the signal amplitude of each data point in each time-of-flight interval with the corresponding threshold to identify and extract the part on which the signal amplitude is higher than the threshold as the effective spectrum part; 2) setting a signal comparator, of which a first input terminal is connected to the ion detector to receive the output analog signal and of which a second input terminal inputs a signal whose amplitude is the threshold, and, when converting the analog signal into a digital signal, recording the moments when the output state of the comparator reverses, and extracting the part of the raw time-of-flight mass spectrum by taking the said recorded moments as starting/ending points of the effective spectrum parts.

In an embodiment of the present invention, detecting the maxima of the obtained wavelet coefficient distribution includes: filtering the detected wavelet coefficient distribution maxima with a preset criterion, so as to determine the position and intensity of each spectral peak therein; the criterion includes one of the followings or a combination thereof: 1) the frequency band or scale of the maxima location is within a preset range; 2) the length of a corresponding ridge line reaches a preset threshold, the so-called ridge line is formed by the following steps: first search the maxima on the said two-dimensional wavelet coefficient distribution (with respect to both time and scale) and set as the starting point; connect each said starting point to the neighboring maxima on the one-dimensional wavelet coefficient distribution with respect to time on the next scale/frequency band (larger or smaller); extend each line to the neighboring maxima on the one-dimensional wavelet coefficient distribution with respect to time on the next scale/frequency band; and so forth until the upper/lower limit of the range of the scale/frequency band is reached; and 3) the corresponding signal-to-noise ratio reaches a preset threshold.

In an embodiment of the present invention, the continuous spectrum processing module is further configured to stack the accumulated characteristic data of the spectral peaks and to merge at least two adjacent time-of-flight intervals to form the spectral peak intensity/time-of-flight histogram.

In an embodiment of the present invention, the signal processing system for analysis of time-of-flight mass spectra is built on a plurality of or multiple groups of arithmetical units; the arithmetical unit includes one of the followings: (1) field-programmable gate arrays; (2) digital signal processors; (3) graphics processing units; or a combination thereof.

In an embodiment of the present invention, the mode of implementing through multiple groups of arithmetical units includes: each group of the arithmetical units processes the raw time-of-flight mass spectra assigned thereto respectively; and each of the effective spectrum parts extracted from each of the raw time-of-flight mass spectra is assigned to each arithmetical unit in the arithmetical unit group processing the raw time-of-flight mass spectrum for further processing.

In an embodiment of the present invention, the signal processing system for analysis of time-of-flight mass spectra further includes: a module for accumulation of the effective spectrum parts, which is configured to accumulate the effective parts of the plurality of continuously collected raw time-of-flight mass spectra acquired by the extraction module, the number of the plurality of raw time-of-flight mass spectra being 1/N of the number of the raw time-of-flight mass spectra required to be processed to form one spectral peak intensity/time-of-flight histogram, N being an integer not less than 20; the module for accumulation of the effective spectrum parts outputs the accumulation result of the effective spectrum parts of the raw spectra to the wavelet transform module for subsequent processing.

In an embodiment of the present invention, the signal processing system for analysis of time-of-flight mass spectra further includes: a spectrum accumulation module, which is configured to accumulate a plurality of raw time-of-flight mass spectra continuously acquired by the extraction module, the number of the plurality of raw time-of-flight mass spectra being 1/N of the number of the raw time-of-flight mass spectra required to be processed to form one spectral peak intensity/time-of-flight histogram, N being an integer not less than 20; the spectrum accumulation module outputs the accumulation result of the plurality of raw time-of-flight mass spectra to the extraction module for subsequent processing.

In order to achieve the above aim and other relevant aims, the present invention provides an electronic apparatus, which includes the signal processing system for analysis of time-of-flight mass spectra; the electronic apparatus may be, for example, electronic data processing apparatuses such as computer, which can realize the functions in the above mentioned embodiments by running programs on a hardware system including a processor (for example, CPU), memory (RAM, ROM) and other components.

As described above, the signal processing method and signal processing system for analysis of time-of-flight mass spectra and the electronic apparatus provided by the present invention include the following steps: (a) digitalizing an analog signal output from an ion detector to acquire a plurality of raw time-of-flight mass spectra; (b) extracting the effective part in each of the raw time-of-flight mass spectra; (c) applying a one-dimensional wavelet transform to each effective part in each of the raw time-of-flight mass spectra respectively to map to each frequency band or scale; (d) determining the position and the intensity of each spectral peak in each of the raw time-of-flight spectra by detecting the maxima of an obtained wavelet coefficient distribution, and saving the peak position and intensity as the characteristic data of each spectral peak; (e) accumulating the characteristic data of the spectral peaks obtained by processing each of the raw time-of-flight mass spectra and stacking the data to form a spectral peak intensity/time-of-flight histogram.

The peak detection algorithm based on wavelet transform used in the present invention, which, compared with the previous signal processing methods of the same type used on the time-of-flight mass spectrometer, for example, the same type of methods disclosed in U.S. Pat. No. 6,870,156 B2 and U.S. Pat. No. 8,063,358 B2, avoids the preprocessing that most conventional peak detection algorithms rely on and that will bring an obvious uncertainty to the result, and therefore can effectively handle some complex conditions such as low signal-to-noise ratios, serious waveform distortion and multi-peak overlap, and thus improves the accuracy and reliability of the peak detection results and thus of the final output spectra.

In the method disclosed in the U.S. Pat. No. 6,870,156 B2, each spectral peak intensity in the characteristic data of spectral peaks is characterized by the raw signal amplitude at the peak position; while in the method disclosed in the U.S. Pat. No. 8,063,358 B2, that is characterized by the area covered by the associated spectral peak on the spectrum (peak area). Generally, the latter characterization is more comprehensive and reliable. In the implementation of the present invention each spectral peak intensity is characterized by the maxima of the wavelet coefficient distribution; according to related discussions in literature [1], actually, the maxima of the wavelet coefficient distribution on effective frequency bands or scales is approximately proportional to the peak area of the associated spectral peak when compared with the characterization of the spectral peak intensity in the previous methods of the same type; accordingly, it is estimated that-use of the method described in the present invention can improve the accuracy and reliability of the spectral peak intensity in the peak detection results and thus of the final output spectra.

Applying the peak detection algorithm based on the wavelet transform to signal processing on a time-of-flight mass spectrometer has one practical problem that the calculation efficiency is too low. To implement the method provided by the present invention, it is needed to first extract the effective parts in each raw time-of-flight mass spectrum and then to perform peak detection only on the extracted effective spectrum parts using the peak detection algorithm; compared with the method reported in literature [1], the method described by the present invention not only greatly reduces the amount of calculation, but also facilitates parallel computing, under the promise of not affecting the processing result, thus being beneficial for obtaining a signal processing rate required by actual applications at a low cost.

The present invention effectively overcomes a variety of shortcomings in existing technologies and has high industrial utilization values.

The above embodiments illustrate the principle and functions of the present invention through examples simply and are not intended to limit the present invention. Those familiar with the technology may make modifications or changes to the above embodiments without departing from the spirit and scope of the present invention. Thus, all modifications or changes accomplished by the ordinary staff in this technical field without departing from the spirit and technical idea disclosed in the present invention are intended to be covered by the claims appended herein.

What is claimed is:

1. A signal processing method for analysis of time-of-flight mass spectra, comprising:

(a) digitalizing an analog signal output from an ion detector to acquire a plurality of complete raw time-of-flight spectra or acquiring each of valid spectrum parts in a plurality of raw time-of-flight spectra one by one for a plurality of times;

(b) if the complete raw time-of-flight spectra are acquired in said step (a), extracting the valid spectrum parts in each of the raw time-of-flight spectra;

(c) applying a one-dimensional wavelet transform to each valid spectrum part in each of the raw time-of-flight spectra to map to each frequency band or scale;

(d) determining the position and the intensity of each spectral peak in each of the raw time-of-flight spectra by detecting the maxima of an obtained wavelet coefficient distribution, and saving said peak position and intensity as the characteristic data of each spectral peak; and (e) accumulating the characteristic data of said spectral peaks obtained by processing each of the raw time-of-flight spectra and stacking the data to form a spectral peak intensity/time-of-flight histogram.

2. The signal processing method for analysis of time-of-flight mass spectra according to claim 1, further comprising: performing further processing said histogram on each of the raw time-of-flight spectra so as to form a continuous spectrum for output.

3. The signal processing method for analysis of time-of-flight mass spectra according to claim 1, wherein, in said step (b), the valid spectrum parts are extracted from the raw time-of-flight spectra by taking a comparison result, which is obtained by comparing the signal amplitude of each data point in the raw time-of-flight spectra with a threshold correlated with a time-of-flight interval in which the data point is located, as a condition, the implementation mode thereof comprising any one of the following ways:

1) setting a plurality of thresholds, each of which is correlated with one time-of-flight interval defined in the raw time-of-flight spectra, and comparing the signal amplitude of each data point in each time-of-flight interval with the corresponding threshold to identify and extract a part on which the signal amplitude is higher than the threshold as one of the valid spectrum parts; and 2) setting a signal comparator, of which a first input terminal is connected to the ion detector to receive the output analog signal and of which a second input terminal inputs a signal whose amplitude is the threshold, and, when converting the analog signal into a digital signal, recording the moments when the output state of the comparator reverses, and extracting spectrum parts of each of the raw time-of-flight spectra as the valid spectrum parts by taking the recorded moments as starting and ending points of the valid spectrum parts.

4. The signal processing method for analysis of time-of-flight mass spectra according to claim 3, further comprising: stacking the accumulated characteristic data of spectral peaks and merging at least two adjacent time-of-flight intervals to form the spectral peak intensity/time-of-flight histogram.

5. The signal processing method for analysis of time-of-flight mass spectra according to claim 1, wherein the signal processing method for analysis of time-of-flight mass spectra is implemented on multiple groups of arithmetical units; the arithmetical units comprise one of the followings: (1) field-programmable gate arrays; (2) digital signal processors; (3) graphics processing units; or a combination thereof.

6. The signal processing method for analysis of time-of-flight mass spectra according to claim 5, wherein a mode of implementing on the multiple groups of arithmetical units comprises:

each group of the arithmetical units groups processing the raw time-of-flight mass spectra assigned thereto respectively; or in one group of the arithmetical units processing one of the raw time-of-flight mass spectra, wherein each arithmetical unit of said one group of the arithmetical units is assigned one valid spectrum part extracted from said one of the raw time-of-flight mass spectra for further processing.

7. The signal processing method for analysis of time-of-flight mass spectra according to claim 1, wherein, after said step (b), the method further comprises: accumulating the extracted valid spectrum parts of a plurality of continuously acquired raw time-of-flight mass spectra, the number of the plurality of raw time-of-flight mass spectra being 1/N of the number of the raw time-of-flight mass spectra required to be processed to form one spectral peak intensity/time-of-flight histogram, N being an integer not less than 20, and then executing step (c) and the following steps on the accumulated result spectra.

8. The signal processing method for analysis of time-of-flight mass spectra according to claim 1, wherein, after step (a), the method further comprises: accumulating the acquired plurality of continuously collected raw time-of-flight mass spectra, the number of the plurality of raw time-of-flight mass spectra being 1/N of the number of the raw time-of-flight mass spectra required to be processed to form one spectral peak intensity/time-of-flight histogram, N being an integer not less than 20, and then executing step (b) and the following steps on the accumulated result spectra.

9. A signal processing system for analysis of time-of-flight mass spectra, comprising:

an raw spectrum acquisition module, which is configured to digitalize an analog signal output from an ion detector to acquire a plurality of complete raw time-of-flight spectra or acquire each of valid spectrum parts in a plurality of raw time-of-flight spectra one by one for a plurality of times;

an extraction module, which is configured to extract the valid spectrum parts from each of the complete raw time-of-flight spectra;

a wavelet transform module, which is configured to apply a one-dimensional wavelet transform to each valid spectrum part in each of the raw time-of-flight spectra to map to each frequency band or scale;

a peak detection module, which is configured to determine the position and intensity of each spectral peak in each raw time-of-flight mass spectrum by detecting maxima on the obtained wavelet coefficient distribution, and save said peak position and intensity as characteristic data of each spectral peak; and an analysis module, which is configured to accumulate the characteristic data of spectral peaks obtained by processing each of the raw time-of-flight mass spectra and stack the data to form a spectral peak intensity/time-of-flight histogram; and multiple groups of arithmetical units to realize functions, comprising one of the followings: (1) field-programmable gate arrays; (2) digital signal processors; (3) graphics processing units; or a combination thereof.

10. The signal processing system for analysis of time-of-flight mass spectra according to claim 9, further comprising: a continuous spectrum processing module, which is configured to perform further processing said histogram on each of the raw time-of-flight spectra so as to form a continuous spectrum for output.

11. The signal processing system for analysis of time-of-flight mass spectra according to claim 9, wherein, in the extraction module, the valid spectrum parts are extracted from each of the raw time-of-flight mass spectra by taking a comparison result, which is obtained by comparing the signal amplitude of each data point in the raw time-of-flight spectra with a threshold corresponding to a time-of-flight interval in which the data point is located, as a condition, the implementation mode thereof comprising any one of the following ways:

1) setting a plurality of thresholds, each of which is correlated with one time-of-flight interval defined in the raw time-of-flight spectra, and comparing the signal amplitude of each data point in each time-of-flight interval with the corresponding threshold to identify and extract the part on which the signal amplitude is higher than the threshold as one of the valid spectrum parts; and 2) setting a signal comparator, of which a first input terminal is connected to the ion detector to receive the output analog signal and of which a second input terminal inputs a signal whose amplitude is the threshold, and, when converting the analog signal into a digital signal, recording the moments when the output state of the comparator reverses, and extracting spectrum parts of each of the raw time-of-flight spectrum spectra as the valid spectrum parts by taking the recorded moments as starting and ending points of the valid spectrum parts.

12. The signal processing system for analysis of time-of-flight mass spectra according to claim 11, wherein the continuous spectrum processing module is further configured to stack the accumulated characteristic data of the spectral peaks and merge at least two adjacent time-of-flight intervals to form the spectral peak intensity/time-of-flight histogram.

13. The signal processing system for analysis of time-of-flight mass spectra according to claim 9, wherein a mode of implementing on the multiple groups of arithmetical units comprises:

each group of the arithmetical units processing the raw time-of-flight mass spectra assigned thereto respectively; or in one group of the arithmetical units processing one of the raw time-of-flight mass spectra, wherein each arithmetical unit of said one group of the arithmetical units is assigned one valid spectrum part extracted from said one of the raw time-of-flight mass spectra for further processing.

14. The signal processing system for analysis of time-of-flight mass spectra according to claim 9, further comprising:

a module for accumulation of the valid spectrum parts, which is configured to accumulate the valid spectrum parts of a plurality of raw time-of-flight spectra continuously acquired by the extraction module, the number of the plurality of raw time-of-flight mass spectra being 1/N of the number of the raw time-of-flight mass spectra required to be processed to form one spectral peak intensity/time-of-flight histogram, N being an integer not less than 20;

said module for accumulation of the valid spectrum parts outputting an accumulation result of the valid spectrum parts of a plurality of said raw spectra to the wavelet transform module for subsequent processing.

15. The signal processing system for analysis of time-of-flight mass spectra according to claim 9, further comprising:

a spectrum accumulation module, which is configured to accumulate a plurality of raw time-of-flight spectra continuously acquired by the raw spectrum acquisition module, the number of the plurality of raw time-of-flight spectra being 1/N of the number of the raw time-of-flight spectra required to be processed to form one spectral peak intensity/time-of-flight histogram, N being an integer not less than 20;

said spectrum accumulation module outputting the accumulation result of the plurality of raw time-of-flight spectra to the extraction module for subsequent processing.

16. An electronic apparatus, comprising the signal processing system for analysis of time-of-flight mass spectra according to claim 9.

* * * * *